United States Patent [19]

Comstock et al.

[11] Patent Number: 5,046,719

[45] Date of Patent: Sep. 10, 1991

[54] PORTABLE PARACHUTE AMUSEMENT RIDE

[76] Inventors: Wayne P. Comstock, 23 Selwyn Dr., Greenville, S.C. 29615; Earl W. Rodrigue, 144 Pine Gate Ct., Greenville, S.C. 29607

[21] Appl. No.: 537,585

[22] Filed: Jun. 14, 1990

[51] Int. Cl.[5] ..... A63J 5/12

[52] U.S. Cl. ..... 272/6; 272/29

[58] Field of Search ..... 272/6, 26, 50, 51, 37, 272/38

[56] References Cited

U.S. PATENT DOCUMENTS

| | | | |
|---|---|---|---|
| 2,374,627 | 4/1945 | Strung | 272/6 |
| 3,456,943 | 7/1969 | Brown | 272/29 |
| 3,596,905 | 8/1971 | Brown | 272/29 |
| 3,612,517 | 10/1971 | Schwarzkopf | 272/29 |
| 3,787,046 | 1/1974 | Clem | 272/29 |
| 3,885,503 | 4/1974 | Barber | 272/29 X |
| 3,904,194 | 9/1975 | Schwarzkopf | 272/29 X |
| 3,905,596 | 9/1975 | Barber | 272/29 |
| 4,007,926 | 2/1977 | Ottaway | 272/29 |

*Primary Examiner*—Richard E. Chilcot, Jr.

*Attorney, Agent, or Firm*—Cort Flint

[57] ABSTRACT

A portable amusement ride (A) having a plurality of parachute passenger carrier units (60) is disclosed which includes an elongated town (B) movable from a retracted position to an extended position. A folding arm assembly (C) deploys to provide an umbrella assembly from which parachute carrier units (60) are raised and lowered. Tower (B) is erected by a ram (E) and acutators (F) which act in opposite directions on tower (B) to pull and push it up to the extended position. Base (10) of tower (B) slides on a carrier plate (20) which is guided by track groove (16*a*, 18*a*). With tower (B) in the retracted, stowed position, it is locked to the trailer base (12) by means of a support lock (87) so that the tower acts as a tongue to pull the short base trailer. In this way, a very short base trailer may be utilized for the portable amusement ride as would otherwise require a long bed trailer.

25 Claims, 6 Drawing Sheets

PORTABLE PARACHUTE AMUSEMENT RIDE

BACKGROUND OF THE INVENTION

This invention relates to the field of amusement rides, and more particularly to a portable amusement ride of the parachute type which can be conveniently and reliably erected and taken down for transportation to different amusement park sites.

Previously, parachute amusement rides have been proposed and utilized which include a permanent installation. The amusement ride typically includes a tower anchored to a ground base. At the remote end of the tower, a plurality of arms extend outwardly in a cantilevered manner. From the arms, parachute rides are raised and lowered. Typically, the ride consists of raising the passenger unit to the top, rapidly releasing the passenger unit with parachute deployed, and then a gradual descent at the lower portion of the ride simulating the effect of a parachute. While parachute rides have become increasingly popular in major amusement parks, the construction and nature of parachute rides renders it impractical for traveling amusement shows which move from site to site. In particular, the large tower typically associated with previous parachute rides does not lend itself to convenient and reliable erection and take down as is necessary in a transportable type amusement ride.

Portable amusement rides have been proposed which utilize a mast of some type such as shown in U.S. Pat. No(s). 3,787,046 and 3,222,061. These patents disclose amusement rides which utilize a mast of limited height. The structure illustrated would not be suitable for a portable parachute ride which requires substantially more vertical distance than the mast arrangements that the prior art have provided. U.S. Pat. No. 987,419 discloses a tower with outwardly extending arms carried near an upper portion of the tower by which passenger carrying unit are raised and lowered.

Accordingly, an object of the invention is to provide a parachute amusement ride in a transportable form which may be conveniently and reliably erected and taken down for movement to different amusement park sites.

Another object of the invention is to provide a portable parachute amusement ride employing a tower which may be erected on a relatively small base and transported on the base in the form of a small and simple trailer construction.

Another object of the invention is to provide a portable amusement ride having an arrangement by which a tower may be erected from a small trailer base and thereafter provided with an upper umbrella mechanism having outwardly extending arms that provides for vertically moving rides which may begin and end outside of the perimeter of the trailer base.

Another important object of the invention is to provide a trailer arrangement for a portable amusement ride of the type having a tower by which the tower may be erected in a vertical configuration from a relatively small base trailer and thereafter folded down to a trailer configuration from which said amusement ride may be towed by a tow vehicle from the trailer base.

SUMMARY OF THE INVENTION

The above objectives are accomplished according to the present invention by providing a portable amusement ride, which may be of a parachute type, that includes a trailer having a short base, a tower carried by the base having a retracted position on the base and an erect position on the base. A ram moves a base of the tower on the trailer in a first direction and an actuator moves a medial portion of the tower in an opposite direction during movement from the retracted position to the erect position. This compound application of force to the tower enables a very long tower to be efficiently and reliably moved from a retracted, collapsed position to an erect, vertical position. Both the ram and actuator are provided by arrangements of fluid cylinders. The ram cylinder moves the base of the tower in linear motion while the actuating cylinder moves the tower in a pivoting motion. A foldable arm assembly at the top of the tower may be unfolded to provide support for movable passenger carrier units. In the illustrated embodiment, the movable passenger carrier units are parachute chairs which move up and down when the tower is erect. A short base trailer may be utilized both for towing the portable ride and as a platform for loading and unloading passengers. In this case, the tower is locked to the trailer in its retracted position so that the tower may act as a trailer tongue for pulling the trailer.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
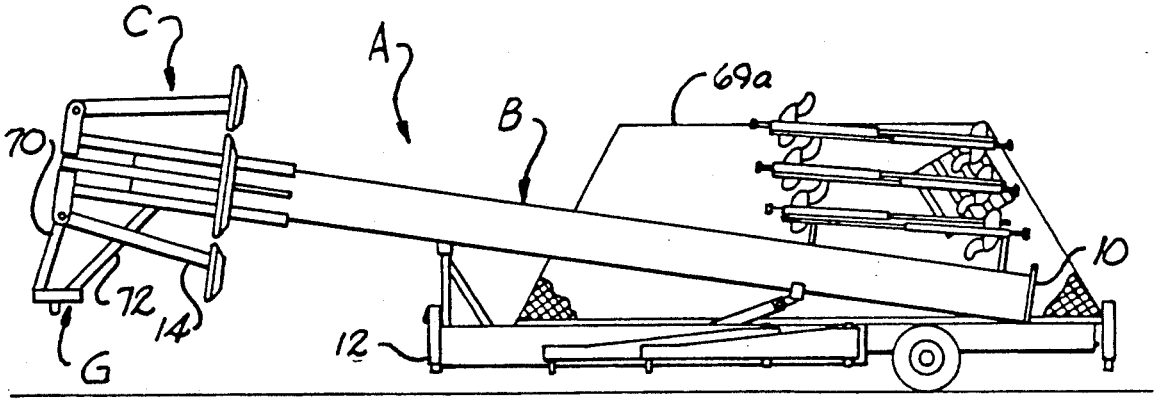
FIG. 1 is a front elevation illustrating a portable amusement ride constructed in accordance with the present invention in a retracted position.
Figure 2:
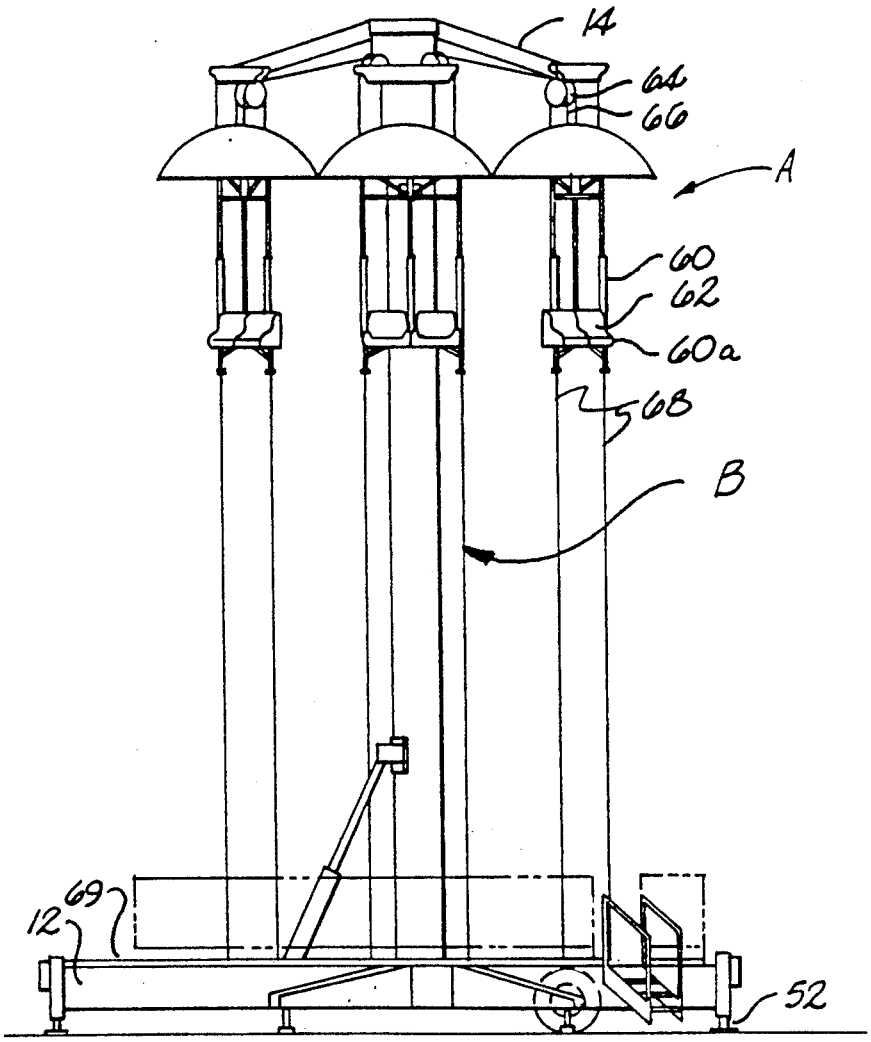
FIG. 2 is a side elevation illustrating a portable amusement ride according to the invention in an erected position.
Figure 3:
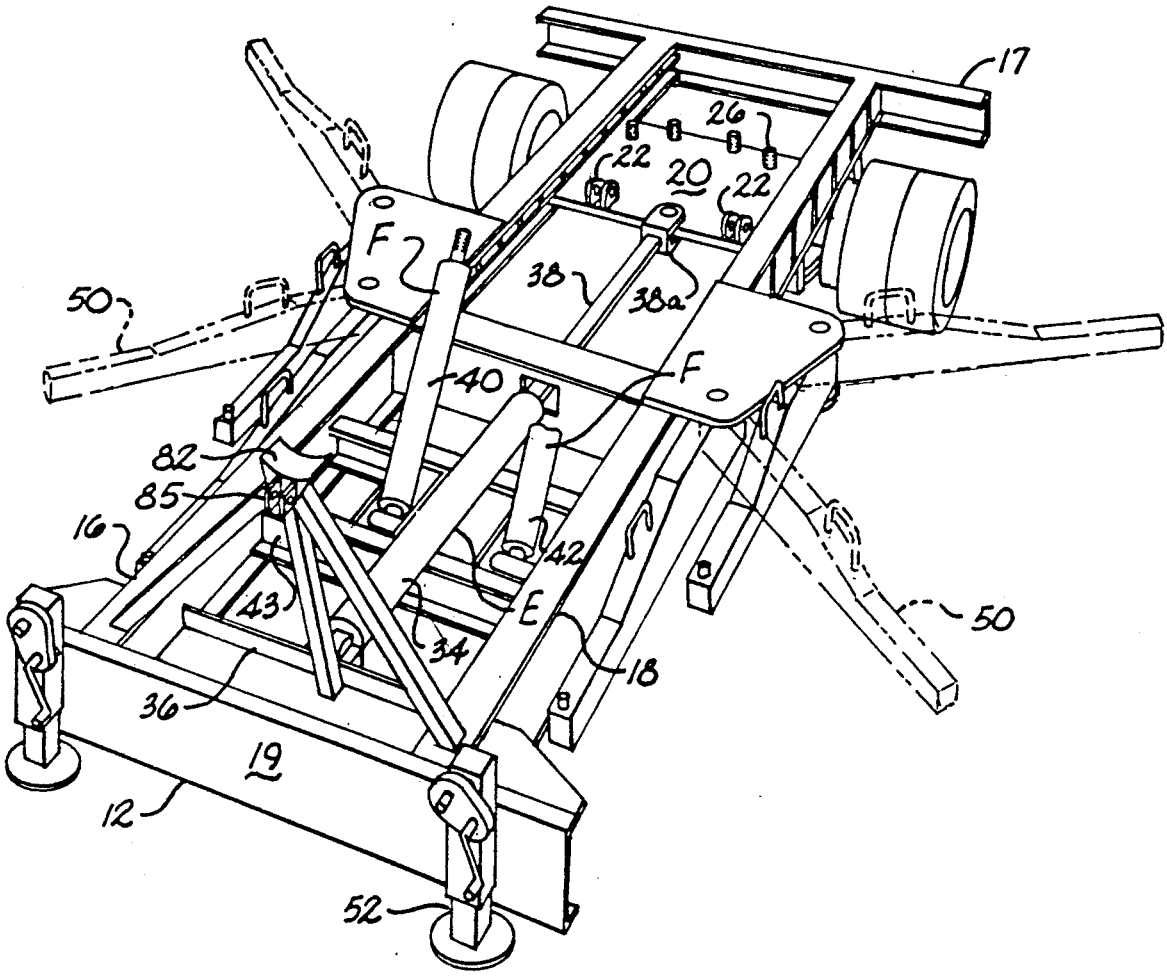
FIG. 3 is a perspective view of a trailer base for carrying a portable amusement ride constructed in accordance with the invention.

Referring now in more detail to the drawings, a portable amusement ride designated generally as A is disclosed which includes a tower B having a base 10. A trailer 12 carries tower B. A foldable arm assembly C is carried near an end of tower B opposite base 10. Foldable arm assembly C includes a plurality of arms 14 which have a first position in which said arms are folded toward a longitudinal axis of tower B and a second position in which the arms are unfolded and extend outwardly from tower B, as can best be seen in FIGS. 2 and 1, respectively. As can best be seen in FIG. 3, a track means for guiding tower B as it is moved from a retracted position in which the tower is carried by trailer 12 in an inclined position, as is shown in the full line position of FIG. 4, and an erect position in which the tower is carried in a vertical position by the trailer, as shown in the dotted line position of FIG. 4.

Trailer 12 includes a rectangular frame having longitudinal beams 16 and 18, and transverse front and back flanges 17 and 19. As can best be seen in FIGS. 4 and 5, track means D includes generally horizontal track means in the form of track grooves 16*a* and 18*a*, carried by beams 16 and 18, in which a movable carrier 20 having bearing blocks 20*a* is slidably received. Base 10 of tower B includes a base plate A which is pivotally attached to carrier 20 by spaced ears 22 and pivot pin 24. Locking means for locking tower B in the erect position provided by a plurality of threaded bolts 26 on carrier 20 which penetrate corresponding openings (not shown) in base plate 10*a* after which locking nuts 26*a* may be applied to lock the base plate and tower in place.

Drive means is provided for moving tower B from the retracted position to the erect position. The drive means includes a ram means E and an actuating means F which apply forces to tower B at two spaced points and in opposite directions. Ram means E applies a force to the tower in a first direction as shown by arrow 30 and actuating means F applies a force against tower B having a component in an opposite direction 32 as tower B is erected. It is this compound motion that enables the large tower to be carried on such a short base trailer and be retracted and erected in an efficient and reliable manner. As can be seen in more detail by referring to FIGS. 3 and 4, ram means E is provided in the form of a fluid cylinder 34 attached to a transverse bar 36 at a forward end of trailer 12. Cylinder 34 has a reciprocating piston rod 38 attached to carrier 20 at 38*a* which slides in tracks 16 and 18. Actuating means F includes two fluid cylinders 40 and 42 having piston rods 42*a*, 40*a* attached cross flanges 43 of trailer 12, and attached to opposite sides of tower B in a parallel fashion at pivotable attachments 44.

Figure 4:
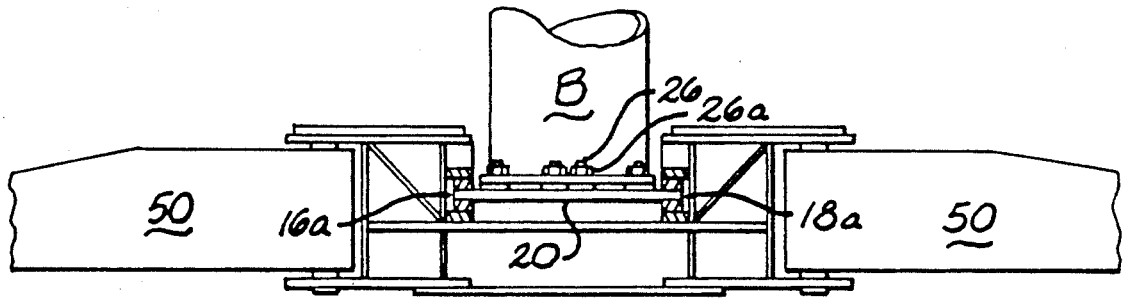
FIG. 4 is a sectional view taken along line 4—4 of FIG. 6 illustrating a tower guided in an erect position according to the invention.
Figure 5:
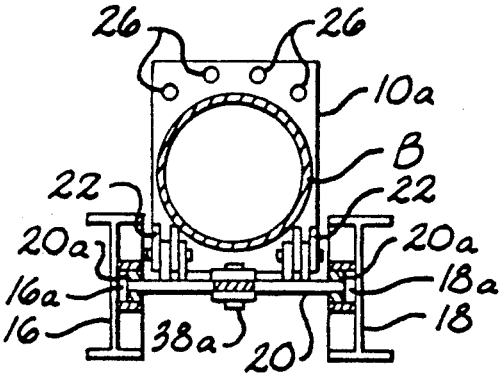
FIG. 5 is a sectional view taken along line 5—5 of FIG. 6 illustrating a tower guided in a retracted position according to the invention.
Figure 6:
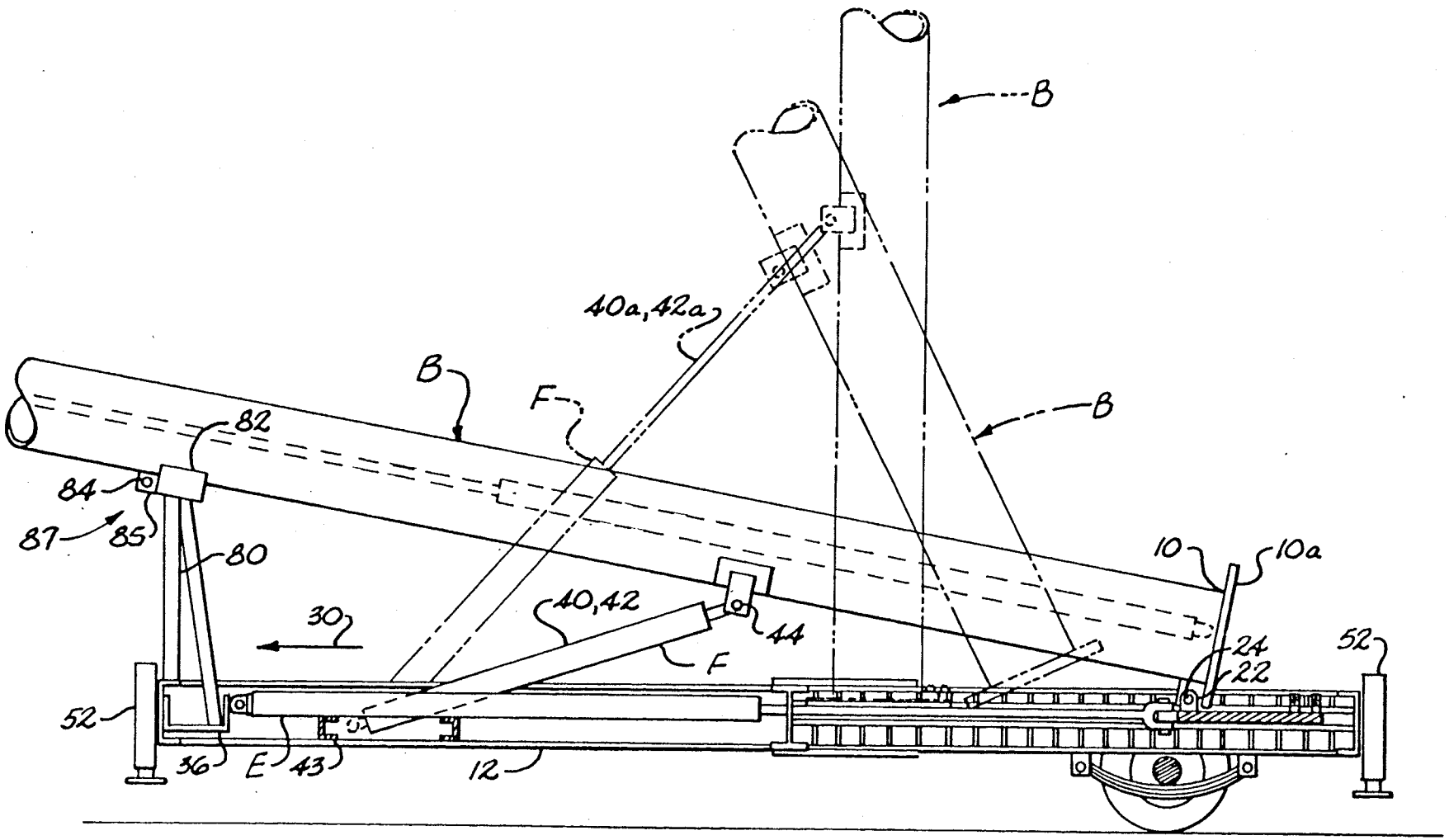
FIG. 6 is a side view of a trailer for a portable amusement ride according to the invention illustrating a tower carried by the trailer being moved from a retracted position to an erect position in accordance with the invention.

In operation, with tower B in the retracted, full line position in FIG. 4, cylinders 40 and 42 pivot tower B about pivot connections 22 and then ram cylinder 34 pulls carrier 20 and base 10 of tower B to the left in a linear motion. For erection, cylinders 40 and 42 fully extend to raise tower B to about 45 degrees before cylinder 34 begins to retract. This compound motion supplied to tower B quickly moves tower B from its retracted inclined position to a full vertical position. Means for stabilizing the tower when erect includes a plurality of legs 50 which operate in a conventional manner. Leveling of the trailer may be accomplished by manual leveling devices 52 at the forward and rear corners of the vehicle. Of course, it is understood that automatic leveling systems may also be utilized to maintain the trailer level during use.

In a preferred embodiment, the invention is utilized in the form of a parachute ride, and a plurality of passenger carrier units 60 will be utilized in the form of standing or seating units. As illustrated, a pair of chairs 62 is employed. Means for raising and lowering the chairs comprises pulleys 64 and cables 66 for raising and lowering carrier unit 60. Guidelines 68 guide the chairs while being raised and lowered. Trailer B carries a foldable platform 69 made of individual pivotal sections 69*a* which fold up for transportation, yet fold down so that passenger carrier units 60 stop on the platform for convenience of passenger loading and unloading.

A trailer hitch means G is provided near the free end of tower B which is secured by support arms 70 and 72. Trailer hitch means G provides a trailer hitch which may be attached to a tow vehicle (not shown) directly so that tower B acts as a trailer tongue and the portable amusement ride may be towed. Preferably, trailer hitch means G is in the form of a fifth wheel 74 which attaches directly to the bed of a tow vehicle. A travel support 80 is included having a cradle 82 which receives tower B. A locking pin 84 passes through a fork 85 (FIG. 3) and a latch plate 86 (FIG. 8) carried by tower B. Latch plate 86 is received between fork 85, and locked, when tower B is in the retracted position. In this manner, the tower and trailer are made unitary with tower B acting as a tongue so that the entire trailer and tower may be towed as one piece by the tow vehicle.

Figure 7:
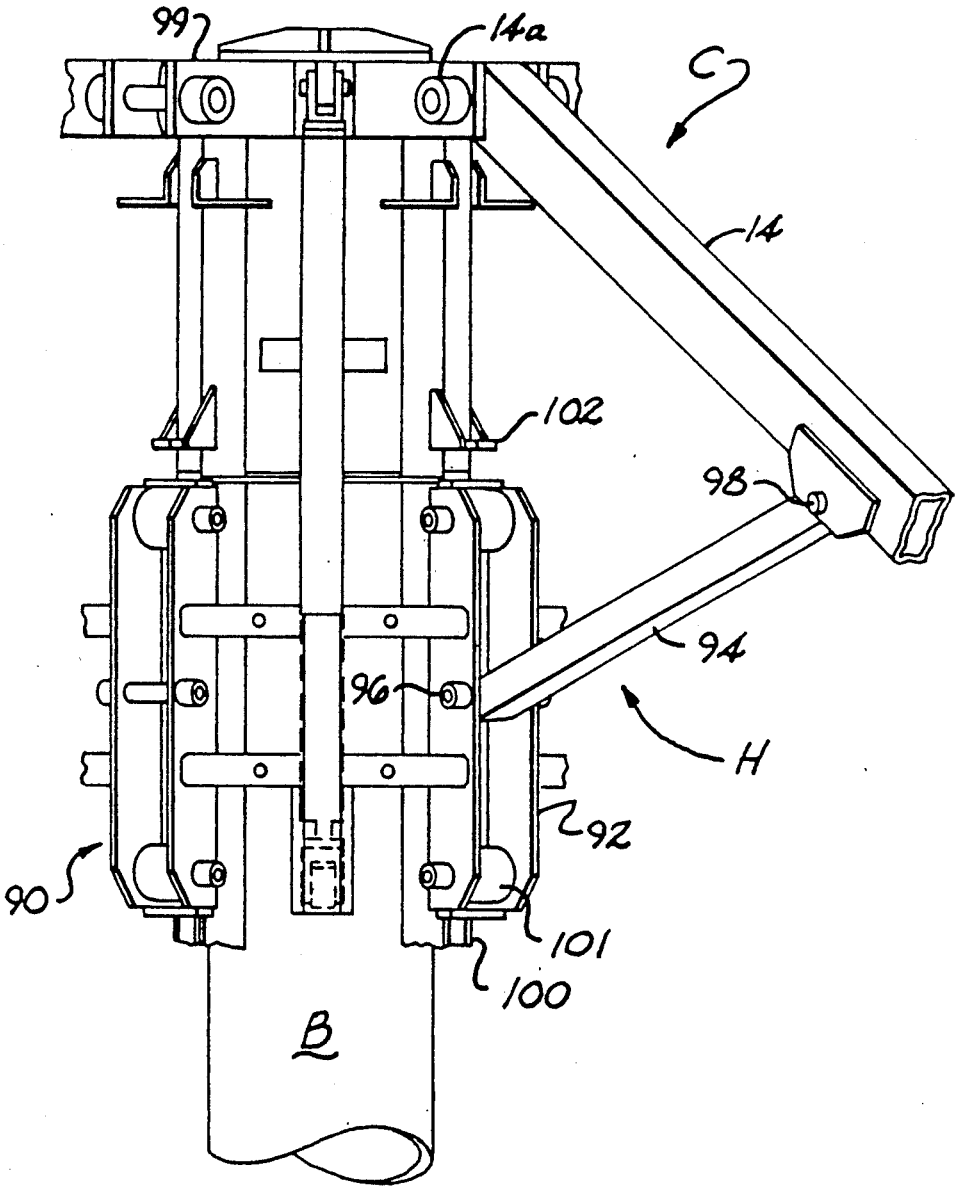
FIG. 7 is a partial elevation illustrating a foldable arm assembly according to the invention.
Figure 8:
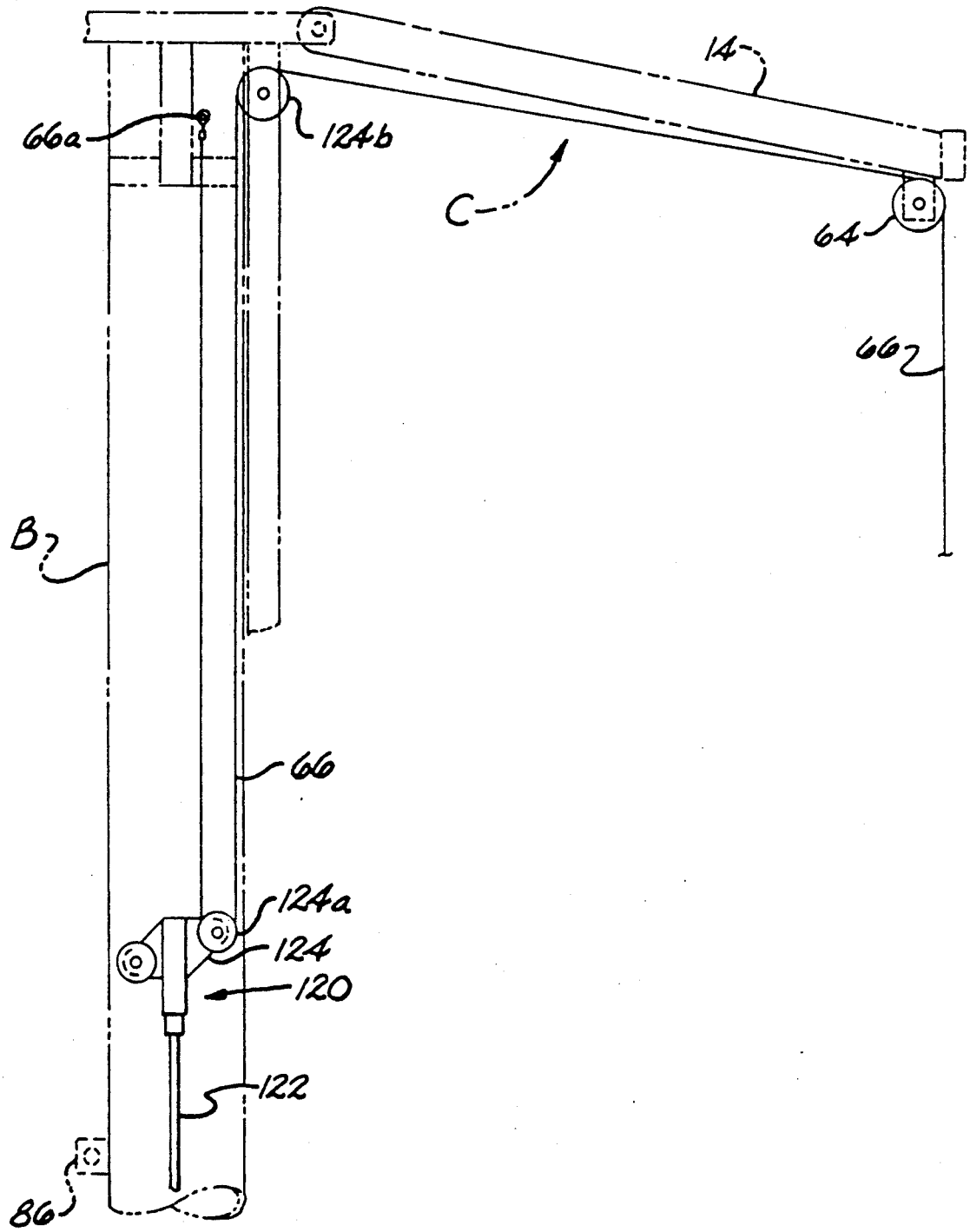
FIG. 8 is a schematic elevation illustrating a mechanism for raising and lowering passenger carrier units.

As can best be seen in FIGS. 7 and 8, deployment means H for folding and unfolding arm assembly C includes a slidable collar, designated generally as 90 having a plurality of ribs 92 to which a linkage 94 is pivotally attached at 96. A remote end of linkage 94 is pivotally attached to assembly arm 14 at pivot 98. The opposite end of folding arm 14 is attached by way of a pivot 14*a* to a collar 99 fixed at near the top of tower B, as can best be seen in FIG. 7. The same construction attaches the remaining arms 14 of folding arm assembly C. Collar assembly 90 is raised and lowered over vertical tracks 1 on tower B by any suitable means such as the use of hydraulic cylinders (not shown). Ribs 92 slide over the tracks by means of rollers 101 carried by the ribs. The hydraulic cylinders may pull or push on the collar to raise it against stops 102. With collar 90 raised against stops 102 the folding arm assembly is deployed in position shown in FIG. 2. The opposite movement of the hydraulic cylinders will move the folding arm assembly to the folded position, as can best be seen in FIG. 1. Of course, any suitable means for folding and unfolding the arm assembly may be utilized in accordance with the present invention without departing from the spirit of the invention. As can best be seen in FIG. 8, means for lowering and raising the passenger carrier units 60 is illustrated. In the illustrated embodiment a pull rod assembly, designated generally as 120, is illustrated as housed within the interior of tower B. A pull rod 122 may be pushed or pulled by any suitable means to raise and lower a pulley assembly 124. One end of cable 66 is fixed at 66*a* while cable 66 wraps about pulley 124*a*, pulley 124*b*, and pulley 64 to raise and lower the passenger carrier units such as 60*a*. Of course, any other suitable means for raising or lowering the passenger carrier units may be utilized in accordance with the invention.

While a preferred embodiment of the invention has been described using specific terms, such description is for illustrative purposes only, and it is to be understood that changes and variations may be made without departing from the spirit or scope of the following claims.

What is claimed is:

1. A portable amusement ride comprising:

a tower having a base;

a trailer for supporting said tower base;

track means for guiding said tower from a retracted position in which said tower is carried in an inclined position by said trailer, and an erect position in which said tower is carried in a vertical position by said trailer;

drive means for moving said tower from said retracted position to said erect position on said trailer;

a foldable arm assembly having a plurality of arms carried near an upper end of said tower having a first position in which said arms are folded toward a longitudinal axis of said tower, and a second position in which said arms are unfolded and extend outwardly from said tower; and deployment means for moving said arm assembly from said first position to said second position upon movement of said tower to said second position.

2. The apparatus of claim 1 wherein said drive means includes a ram means which applies a force to said tower in a first direction, and an actuating means which applies a force to said tower in a second direction which is opposite to said first direction.

3. The apparatus of claim 2 wherein said first and second forces are applied near two spaced points on said tower.

4. The apparatus of claim 2 wherein said actuating means includes a first fluid cylinder connected between said trailer and said tower and a second fluid cylinder connected between said trailer and said tower in a generally parallel arrangement; and said ram means comprises at least a third fluid cylinder connected between said trailer and said tower.

5. The apparatus of claim 4 wherein said first and second fluid cylinders and said third fluid cylinders act on said tower at different points.

6. The apparatus of claim 2 wherein said track means comprises a generally horizontal track, a movable carrier carried by said track, means for pivotally attaching said tower to said movable carrier, and said ram means moves said carrier in reciprocating motions.

7. The apparatus of claim 6 wherein said actuating means imparts a pivoting motion to said tower as said ram means imparts a linear motion to said tower.

8. The apparatus of claim 7 including first locking means for locking said base of said tower to said movable carrier when said tower is in said erect position.

9. The apparatus of claim 1 wherein said track means comprises a horizontal track carried by said trailer; a movable carrier which is guided by said track, and said tower of said base being carried by said carrier.

10. The apparatus of claim 1 including locking means for locking said tower in said erect position.

11. The apparatus of claim 1 wherein said foldable arm assembly comprises:

a movable collar carried near said upper end of said tower;

pivot means connecting said arms to said collar; and said deployment means being connected to said collar arms for moving said collar so as to pivot said arms outwardly to said second position.

12. The apparatus of claim 11 including guide means for sliding said collar vertically parallel to said longitudinal axis of said tower; and linkages connecting said collar to said arms for pivoting said arms to said second position.

13. The apparatus of claim 11 including latch means for latching said arm assembly in said second position.

14. The apparatus of claim 1 including a plurality of passenger carrier units carried by said arms in said second position, and means for raising and lowering said passenger carrier units relative to said trailer.

15. The apparatus of claim 14 including a platform surrounding said trailer from which said passenger carrier units are raised and lowered, and from which passengers load and unload from said carrier units.

16. The apparatus of claim 15 wherein said platform includes a plurality of platform sections pivotally attached to said trailer so that they may be deployed from a stored configuration to a generally horizontal platform configuration.

17. The apparatus of claim 1 including a trailer hitch carried near said upper end of said tower which attaches to a tow vehicle so that said tower and trailer may be towed by said vehicle.

18. The apparatus of claim 17 including a support carried by said trailer for supporting said tower in said retracting position, and a travel support lock for unitarily attaching said tower to said travel support as a unit so that said tower acts as a trailer tongue to draw said trailer when said hitch is attached to said tow vehicle.

19. A portable amusement ride having a plurality of passenger carrier units comprising:

an elongated tower having a tower base;

a trailer base by which said tower base is supported;

support means for supporting a plurality of passenger carrying units near an upper end of said tower;

drive means for moving said tower from a retracted position in which said tower is carried in a substantially horizontal position by said base trailer base, and an erect position in which said tower is carried by said trailer in a generally vertical position; and hitch means carried near said upper end of said trailer for attachment to a tow vehicle, and means for locking said tower and trailer together as a unit so that said tower provides a trailer tongue and said amusement ride may be towed by said tow vehicle with said trailer base.

20. A portable amusement ride comprising:

a tower having a base;

a trailer for supporting said tower base;

track means for guiding said tower from a retracted position in which said tower is carried in an inclined position by said trailer, and an erect position in which said tower is carried in a vertical position by said trailer;

drive means for moving said tower from said retracted position to said erect position on said trailer; and said drive means includes a ram means which applies a force to said tower in a first direction, and an actuating means which applies a force to said tower in a second direction which is opposite to said first direction.

21. The apparatus of claim 20 wherein said first and second forces are applied near two spaced points on said tower.

22. The apparatus of claim 20 wherein said track means comprises a generally horizontal track, a movable carrier carried by said track, means for pivotally attaching said tower to said movable carrier, and said ram means moves said carrier in reciprocating motions.

23. The apparatus of claim 22 wherein said actuating means imparts a pivoting motion to said tower as said ram means imparts a linear motion to said tower.

24. The apparatus of claim 23 including first locking means for locking said base of said tower to said movable carrier when said tower is in said erect position.

25. The apparatus of claim 20 wherein said actuating means is actuated prior to said ram means.

* * * * *